United States Patent [19]

Liou

[11] Patent Number: 5,062,791

[45] Date of Patent: Nov. 5, 1991

[54] GAS BLOWTORCH

[76] Inventor: Charg-Shing Liou, No. 647, Fu-Hsing Rd., Fu-Hsing Li, Tsao-Tun Chen, Nan-Tou Hsien, Taiwan

[21] Appl. No.: 678,218

[22] Filed: Apr. 1, 1991

[51] Int. Cl.[5] ..... F23Q 7/12

[52] U.S. Cl. ..... 431/266; 431/344; 431/354

[58] Field of Search ..... 431/266, 264, 258, 344, 431/345, 354, 350, 351, 352, 353; 126/403, 407, 412, 413

[56] References Cited

U.S. PATENT DOCUMENTS

| | | | |
|---|---|---|---|
| 1,763,289 | 6/1930 | Anderson et al. | 431/344 |
| 2,666,480 | 1/1954 | Peterson | 431/344 |
| 4,553,927 | 11/1985 | Collins, Jr. | 431/266 |
| 4,597,732 | 7/1986 | Yoshinaga | 431/344 |
| 4,720,259 | 1/1988 | Day | 431/345 |
| 4,938,686 | 7/1990 | Yoshinaga | 431/344 |
| 4,952,138 | 8/1990 | Ho | 431/344 |

FOREIGN PATENT DOCUMENTS

| | | | |
|---|---|---|---|
| 1127635 | 12/1956 | France | 431/344 |

*Primary Examiner*—James C. Yeung
*Attorney, Agent, or Firm*—Harness, Dickey & Pierce

[57] ABSTRACT

A blowtorch includes a replaceable gas cylinder and a hollow base having an opening to slidingly receive a lower portion of the gas cylinder. A torch head is mounted horizontally on one end of a tubular support rod extending perpendicular to and upward from the first plate. The torch head has a gas outlet formed on a front end, a gas regulator provided on a rear end to control gas flow through the gas outlet, and a downwardly extending gas inlet engaging the gas cylinder to permit controlled release of gas contained in the gas cylinder through the gas outlet. A protective cover assembly is longer than and is detachably fitted over the torch head. A spark igniter is mounted on the torch head. A control device generates a high voltage output to trigger the spark igniter to produce a spark. Gas released at the gas outlet mixes with air to form a combustible mixture. The spark produced by the spark igniter ignites the combustible mixture to produce a flame output.

6 Claims, 6 Drawing Sheets

GAS BLOWTORCH

BACKGROUND OF THE INVENTION

1. Field of the Invention

The present invention relates to blowtorches, and more particularly to a blowtorch construction which can be easily assembled/disassembled by the end user to facilitate cleaning and repair of the blowtorch.

2. Description of The Related Art

Referring to FIG. 1, a conventional blowtorch is shown to comprise: a base plate (A); a support member (B) extending perpendicular to and upward from the base plate (A); a torch head (C) mounted horizontally on one end of the support member (B); and a replaceable gas cylinder (D) having a bottom end resting on the base plate (A). The torch head (C) has a gas outlet (not shown) on its front end, a gas regulator (Cl) provided on its rear end to control the flow of gas through the gas outlet, and a downwardly extending gas inlet (C2) which engages the gas cylinder (D), permitting the controlled release of gas contained by the gas cylinder (D) through the gas outlet.

The main disadvantages of the above disclosed conventional blowtorch are as follows:

1. A protective cover (C3) is integrally formed and extends forward from a front end of the torch head (C). The protective cover (C3) cannot be detached from the torch head (C), making it difficult to clean and repair the torch head (C).

2. The bottom end of the gas cylinder (D) is merely seated on the base plate (A). Accidental disengagement of the gas cylinder (D) from the gas inlet (C2) is likely to happen since the gas cylinder (D) is in a relatively unstable position.

3. To conserve gas, the flame output of the blowtorch must be constantly adjusted since it is not necessary to always maintain a strong flame output. This is done by operating the gas regulator (Cl) to correspondingly adjust gas flow through the gas outlet. When the gas flow is relatively small, the flame output of the blowtorch is relatively weak and can be easily extinguished by strong winds. Once extinguished, the ignition procedure must be repeated, thereby inconveniencing the user.

SUMMARY OF THE INVENTION

Therefore, the main objective of the present invention is to provide an improved blowtorch construction which facilitates cleaning, inspection and repair of the torch head.

Another objective of the present invention is to provide an improved blowtorch construction in which the gas cylinder is maintained at a stable position to prevent its accidental disengagement.

Still another objective of the present invention is to provide a blowtorch having provisions to permit continuous ignition of combustible gas to prevent the flame output of the blowtorch from being accidentally extinguished.

Accordingly, the preferred embodiment of a blowtorch of the present invention comprises: a replaceable gas cylinder; a base including a hollow body having an open top end and defining a hollow space, a first plate covering the open top end and having an opening to slidingly receive a lower portion of the gas cylinder, a second plate projecting inward from the hollow body and into the hollow space, said second plate being vertically spaced apart from the first plate and being aligned with the opening, a third plate disposed inside the hollow space between the opening and the second plate, said gas cylinder having a bottom end resting on the third plate, and a spring to bias the third plate away from the second plate; a tubular support rod extending perpendicular to and upward from a portion of the first plate which is spaced from the opening; a torch head mounted horizontally on a distal end of the tubular support rod and having a front end, a rear end, a gas outlet formed on the front end, a gas regulating means provided on the rear end to control gas flow through the gas outlet, and a downwardly extending gas inlet means engaging the gas cylinder to permit controlled release of gas contained in the gas cylinder through the gas outlet; a protective cover assembly which is detachably fitted over the torch head, and is longer than the torch head, said protective cover assembly including a pair of elongated casing halves each having one side hinged to the other casing half, the other side of each casing half being releasably secured to the other casing half; a spark igniter means mounted on the torch head; and means for generating a high voltage output to trigger the spark igniter means to produce a spark, including a cell means having a low voltage output, a voltage transforming means to transform the low voltage output to the high voltage output, and a switching means to selectively connect the cell means and the voltage transforming means. Gas released at the gas outlet mixes with air to form a combustible mixture. The spark produced by the spark igniter means ignites the combustible mixture to produce a flame output.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
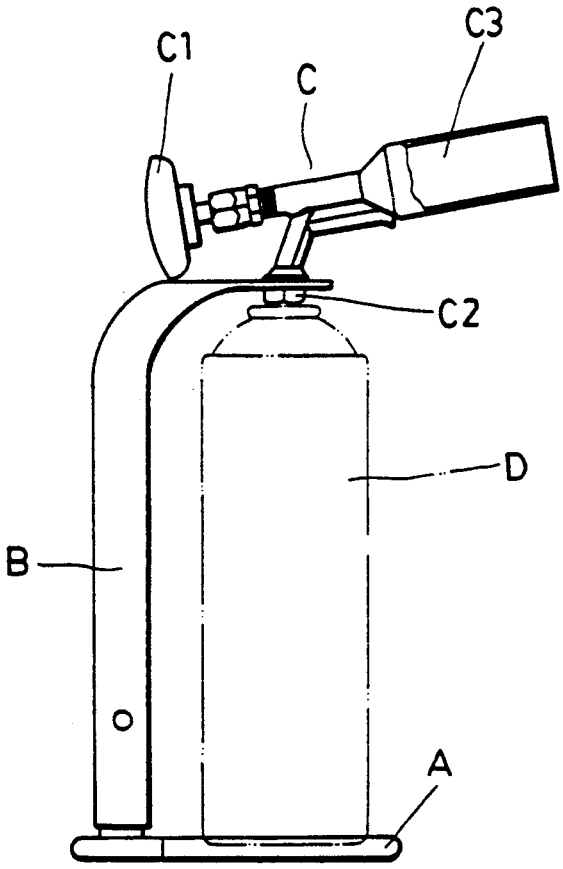
FIG. 1 PRIOR ART
FIG. 1 is a perspective view of a conventional blowtorch.
Figure 2:
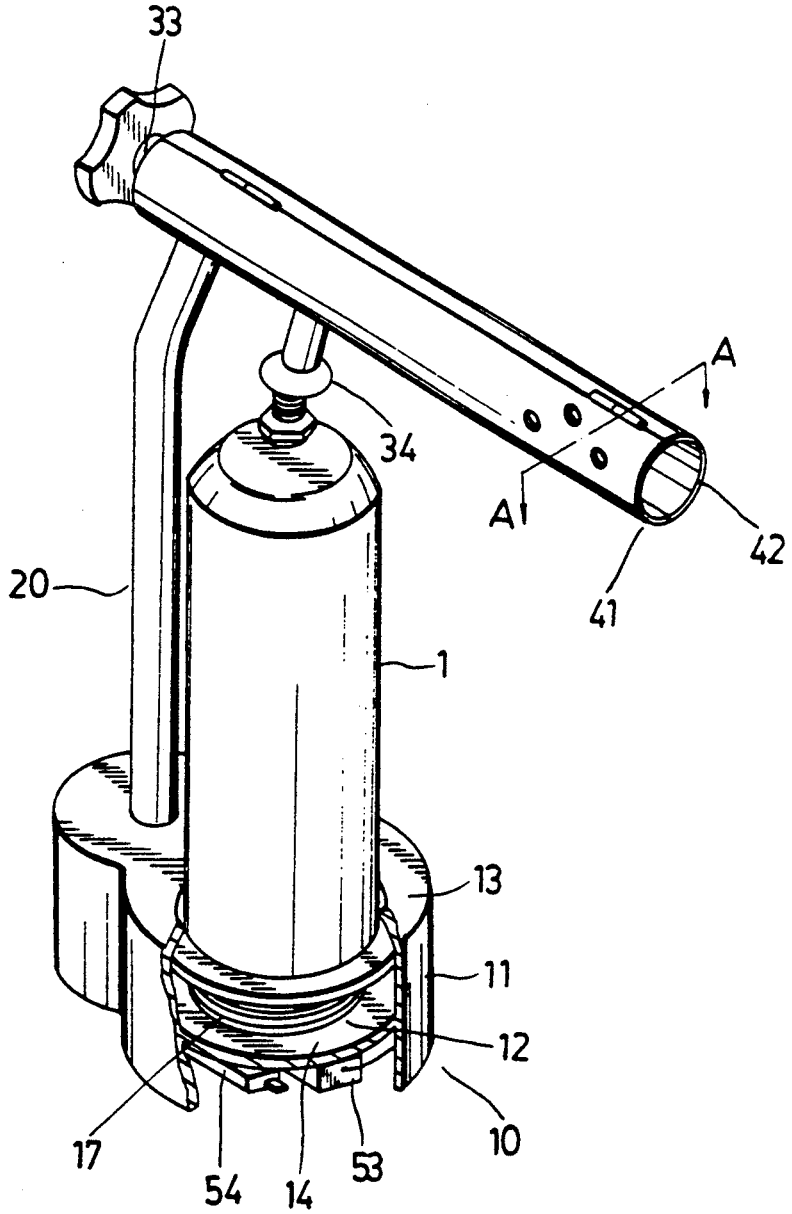
FIG. 2 is a perspective view of the preferred embodiment of a blowtorch according to the present invention.
Figure 3:
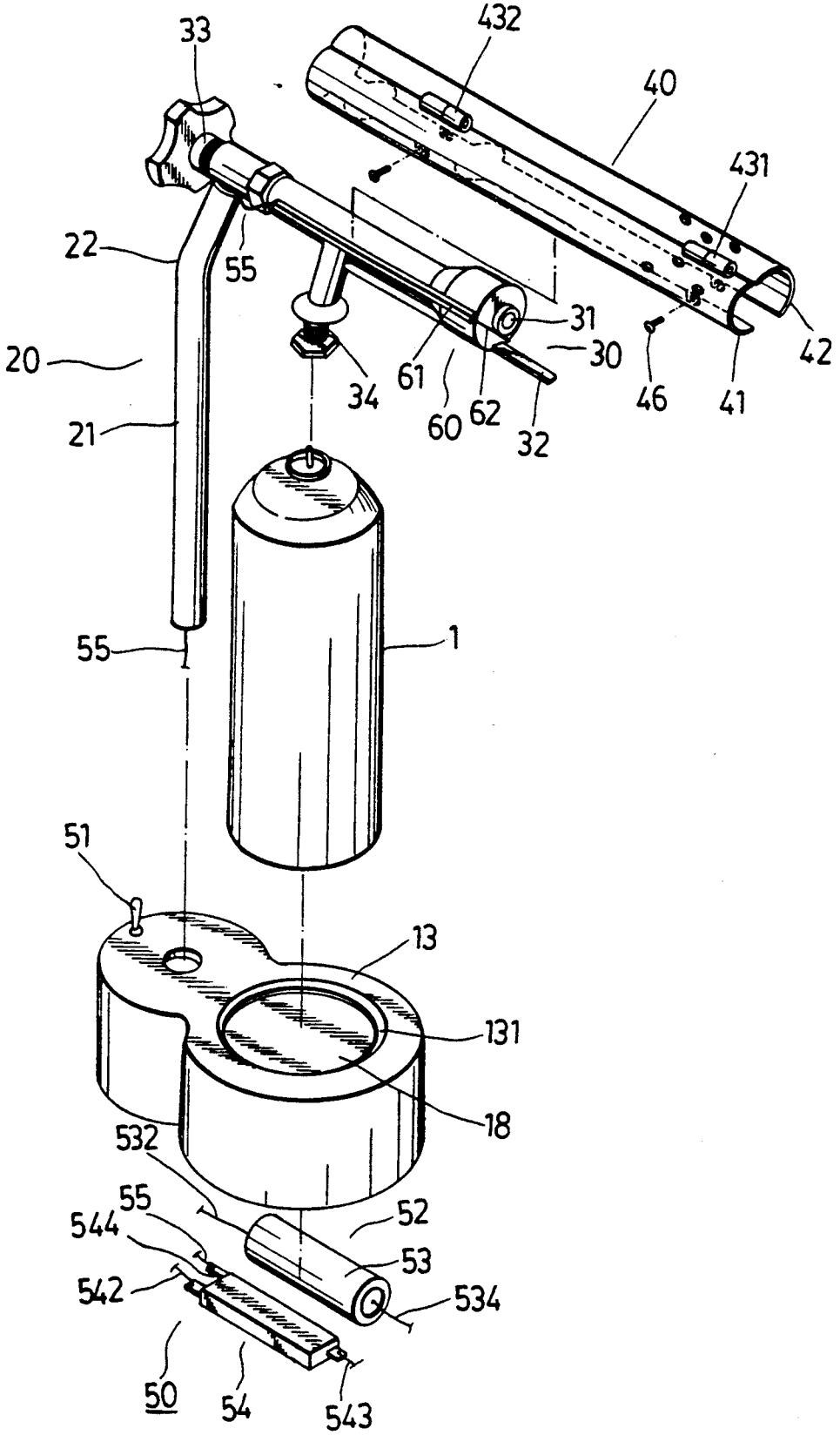
FIG. 3 is an exploded view of the preferred embodiment.
Figure 4:
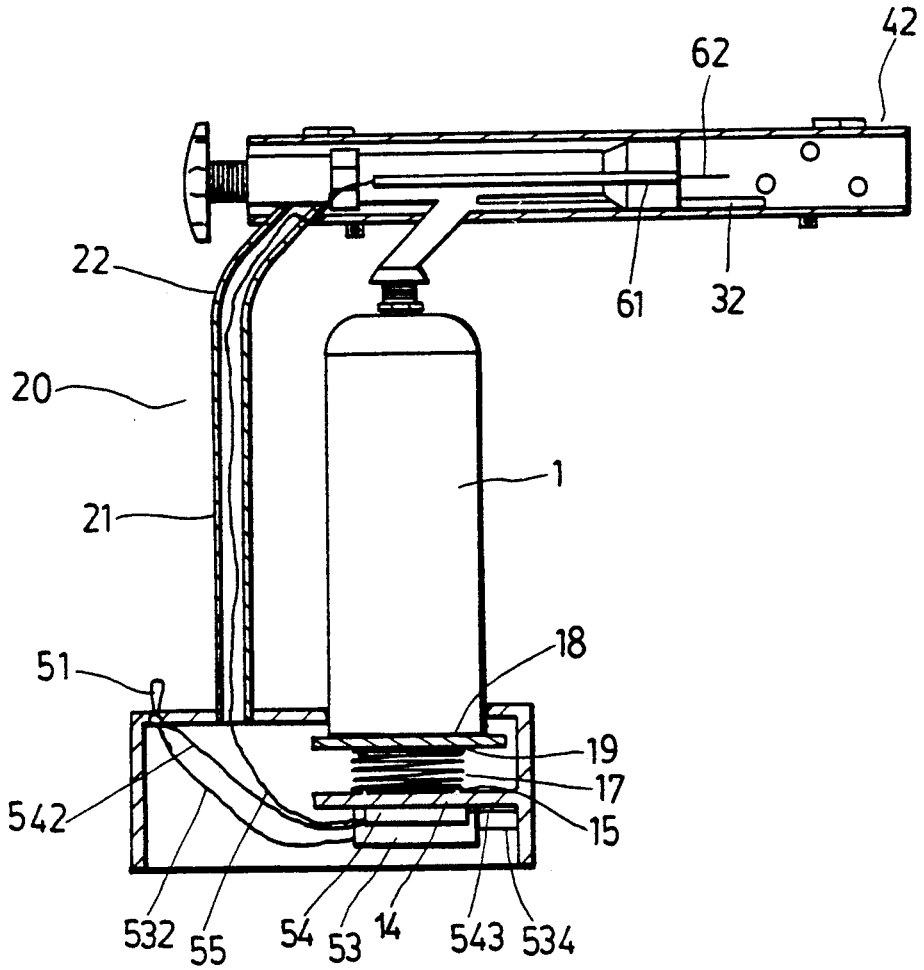
FIG. 4 is a partially sectional view of the blowtorch of the present invention illustrating its assembly.

Referring to FIGS. 2, 3 and 4, the preferred embodiment of a blowtorch according to the present invention is shown to comprise a base 10, a tubular support rod 20, a torch head 30, a protective cover assembly 40, a control device 50, and a spark igniter 60.

The base 10 has a hollow metal body 11 defining a hollow space 12, and a first plate 13 covering an open top end of the hollow body 11. The first plate 13 has an opening 131 to slidingly receive the lower portion of a replaceable gas cylinder 1. The opening 131 is gradually tapered from an outer surface of the first plate 13 to an inner surface of the same. This facilitates passage of the gas cylinder 1 through the opening 131. A second plate 14 projects inward from the hollow body 11 and into the hollow space 12. The second plate 14 is vertically spaced apart from the first plate 13 and is aligned with the opening 131. A third plate 18 is disposed inside the hollow space 12 between the opening 131 and the second plate 14. The second plate 14 has an upwardly extending annular projection 15. The third plate 18 has a downwardly extending annular projection 19 concentric with the annular projection 15. Two ends of a helical spring 17 are fixed on the annular projections 15 and 19. The helical spring 17 thus biases the third plate 18 away from the second plate 14.

The tubular support rod 20 has a first rod portion 21 extending perpendicular to and upward from a portion of the first plate 13 which is spaced from the opening 131. The first rod portion 21 has a lower end fixed to the first plate 13. The hollow space confined by the tubular support rod 20 is communicated with the hollow space 12. The tubular support rod 20 further has a bent second rod portion 22 extending upward from the upper end of the first rod portion 21.

The torch head 30 is mounted horizontally on a distal end of the bent second rod portion 22. The torch head 30 is thus disposed at a distance from the base 10, to provide ample room for maneuvering the gas cylinder 1, as will be shown in the succeeding paragraphs. The torch head 30 has a front end formed with a gas outlet 31. An elongated blocking plate 32 is disposed on a lower end of the torch head 30. The torch head 30 further has a rear end provided with a gas regulator 33 to control the flow of gas through the gas outlet 31, and a downwardly extending gas inlet 34 adapted to engage the top end of the gas cylinder 1. The constructions of the gas regulator 33 and the gas inlet 34 are known in the art and will not be detailed further.

Figure 5:
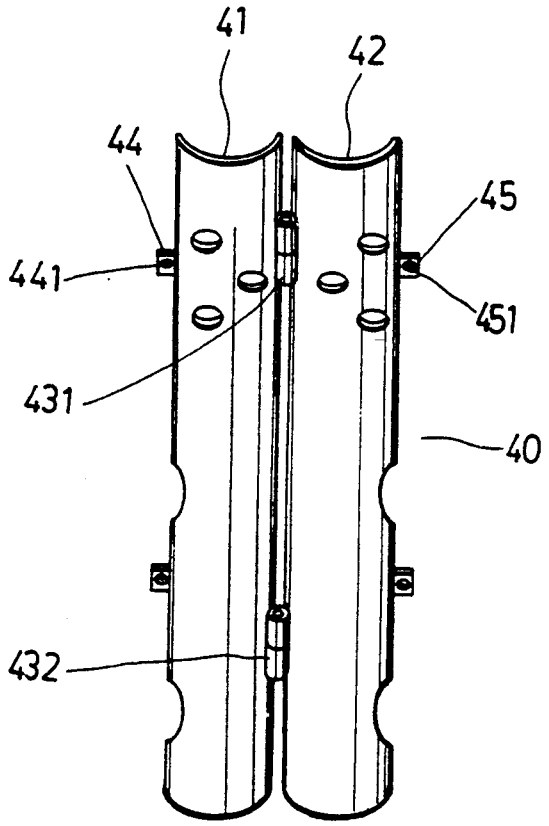
FIG. 5 is an illustration of a protective cover assembly of the preferred embodiment.
Figure 6:
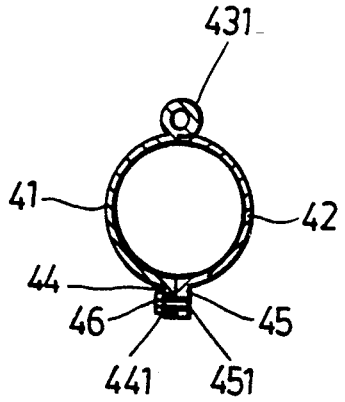
FIG. 6 is an A—A section of FIG. 1 to illustrate assembly of the protective cover assembly.

The protective cover assembly 40 is fitted over and is longer than the torch head 30. The protective cover assembly 40 includes a pair of elongated cylindrical casing halves, 41 and 42, which are semi-circular in cross section and are made of metal. Referring to FIG. 5, a pair of hinge devices, 431 and 432, rotatably connect one side of each of the casing halves, 41 and 42. The casing halves, 41 and 42, are thus turnable from the open position shown in FIG. 5, to the closed position shown in FIG. 2. Each of the casing halves, 41 and 42, is also provided with a pair of outwardly extending nut projections, 44 and 45, which are located opposite to the hinge devices, 431 and 432. Referring to FIGS. 5 and 6, the nut projections 44 each have a through hole 441 while the nut projections 45 each have a threaded opening 451 to be aligned with one of the through holes 441. A pair of screws 46 are received by the nut projections, 44 and 45, and are provided to secure the casing halves, 41 and 42, in the closed position.

Figure 7:
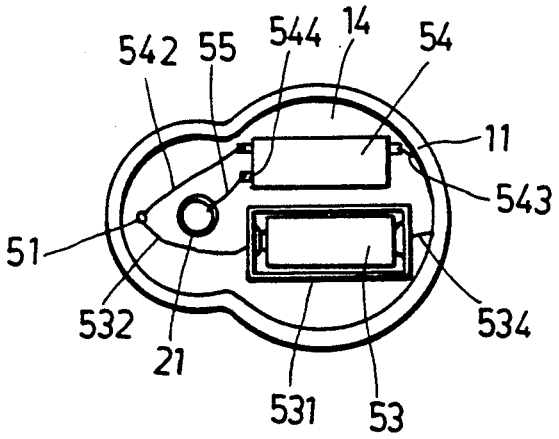
FIG. 7 is an illustration of a control device of the blowtorch of the present invention.

Referring once more to FIGS. 3 and 4, the control device 50 comprises a pole switch 51 pivotably mounted on the first plate 13, and a power supply means 52 including a battery cell 53 disposed in a battery seat 531 secured to the bottom side of the second plate 14. Referring to FIG. 7, a first conductor 532 electrically connects the positive terminal of the battery cell 53 to the pole switch 51. A second conductor 534 electrically connects the negative terminal of the battery cell 53 to the hollow body 11. An integrated circuit (IC) means 54 is mounted on the second plate 14 adjacent to the battery seat 53. A third conductor 542 electrically connects a supply terminal of the IC means 54 to the pole switch 51. A fourth conductor 543 electrically connects the ground terminal of the IC means 54 to the hollow body 11. The IC means 54 has an output terminal 544 connected to one end of a high voltage electrical cable 55. The IC means 541 transforms the voltage output of the battery cell 53 to generate a much higher voltage output. Referring once more to FIG. 4, the electrical cable 55 should be long enough to extend through the tubular support rod 20.

Referring again to FIGS. 3 and 4, the spark igniter 60 is mounted on the torch head 30. The spark igniter 60 includes an elongated ceramic insulator 61 mounted on one side of the torch head 30, and an electrode 62 having one end axially extending through the ceramic insulator 61 and disposed adjacent to the gas outlet 31. The other end of the electrode 62 is connected to the electrical cable 55. The ceramic insulator 61 extends from the front end of the torch head 30 to the rear end of the same. This permits the electrical cable 55 to be positioned far away from the high temperature combustion area. The tip of the electrode 62 should be spaced from the casing half 41 to cooperatively form a spark gap.

Operation and use of the preferred embodiment is as follows: Referring to FIG. 4, initially, the spring 17 urges the third plate 18 to abut the bottom of the first plate 13, thereby covering the opening 131. When loading the gas cylinder 1, the lower portion of the gas cylinder 1 is slidingly received in the opening 131. An axial downward force, applied on the third plate 18, pushes the third plate 18 downward to compress the spring 17. Once loaded, regardless of whether the lower end of the gas cylinder is in partial or full contact with the third plate 18, the third plate 18 is always maintained in a level position, thereby preventing separation and collapse of the third plate 18 from the spring 17. Since the gas cylinder 1 is slidingly received in the opening 131, tilting of the gas cylinder 1 is prevented to correspondingly prevent tilting of the third plate 18. When loaded, the top end of the gas cylinder 1 can be easily attached to the gas inlet 34. When the axial downward force applied to the third plate 18 is relaxed, the spring 17 expands to urge the gas cylinder 1 toward the gas inlet 34, thereby achieving tight contact between the gas cylinder 1 and the gas inlet 34. The vertical movement of the third plate 18 also permits loading of gas cylinders 1 of different lengths.

Figure 8:
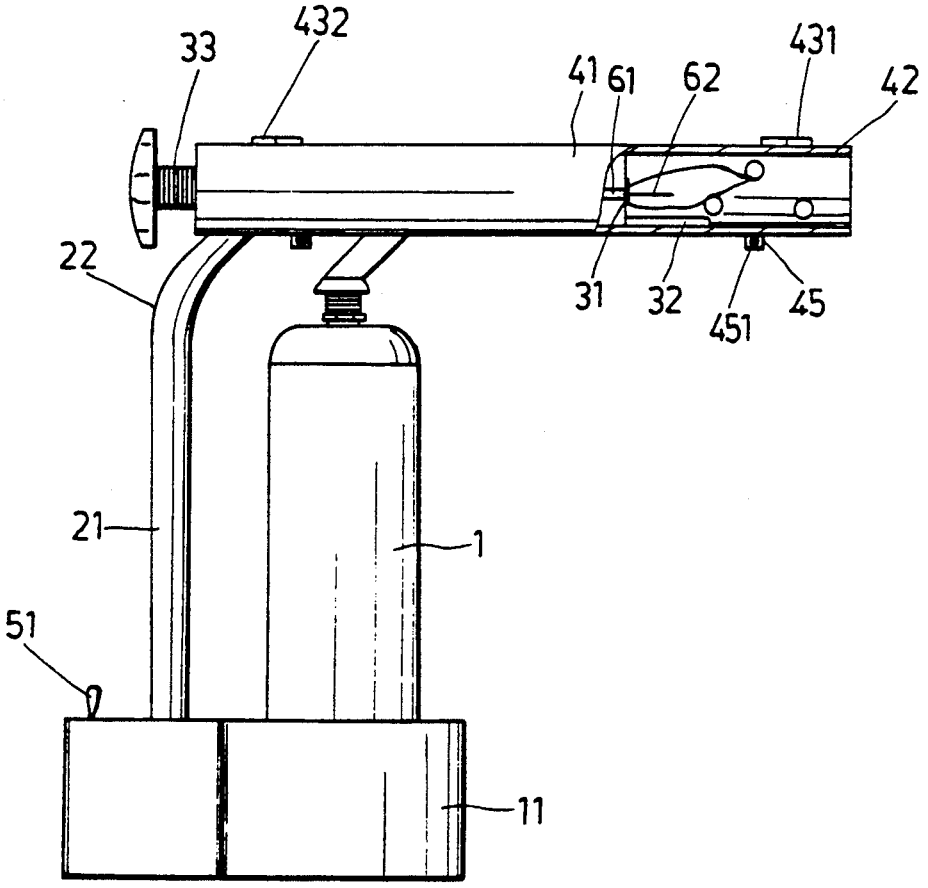
FIG. 8 is a schematic partly sectional view of the preferred embodiment when in an operating condition.

Once the gas cylinder 1 has been properly attached, the gas regulator 33 is then operated to release gas contained by the gas cylinder 1 through the gas outlet 31. Gas released at the gas outlet 31 then mixes with air inside the protective cover assembly 40 to form a combustible mixture. Referring to FIGS. 4 and 7, the pole switch 51 is then actuated to generate a closed circuit condition wherein the positive terminal of the battery cell 53 is connected to the supply terminal of the IC means 54. The IC means 54 then transforms the battery voltage to a high voltage output directed to the electrode 62 via the electrical cable 55, causing a spark to jump between the electrode 62 and the casing half 41. (The IC means 54 is a commercially available circuit package, the configuration of which is known in the art and will not be detailed further). The resulting spark causes the combustible mixture to ignite, thereby producing a flame that shoots out of the open end of the protective cover assembly 40, as shown in FIG. 8. Continuous operation of the IC means 54 prevents the flame output of the preferred embodiment from being snuffed by mistake. The blocking plate 32 prevents the combustible mixture from escaping via an elongated crevice formed between the casing halves, 41 and 42. Aside from prolonging the confinement of combustible mixture inside the combustion area, the protective cover assembly 40 also prevents the wind from blowing out the flame output of the blowtorch.

To reduce the flame output of the blowtorch (since it is not desired to constantly produce a strong flame output when using the preferred embodiment), the gas regulator 33 is operated to gradually reduce the flow of gas through the gas outlet 31. The IC means 54 ensures that a spark will always be generated to continuously ignite the combustible mixture, making accidental extinguishing of the flame output of the preferred embodiment unlikely.

The protective cover assembly 40 is secured to the torch head 30 via screws 46. When conducting repairs or inspection of the torch head 30 or the spark igniter 60, the screws 46 are simply disengaged from the nut projections, 44 and 45, to remove the protective cover assembly 40 from the torch head 30.

Finally, the ceramic insulator 61 extends near the rear end of the torch head 30 to position the electrical cable 55 far away from the high temperature combustion area at the front end of the torch head 30. This protects the electrical cable 55 and the control device 50 from damage due to extremely high temperatures.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A blowtorch, comprising:

a replaceable gas cylinder;

a base including a hollow body having an open top end and defining a hollow space, and a first plate covering said open top end and having an opening to slidingly receive a lower portion of said gas cylinder;

a tubular support rod extending perpendicular to and upward from a portion of said first plate which is spaced from said opening;

a torch head mounted horizontally on a distal end of said tubular support rod, said torch head having a front end, a rear end, a gas outlet formed on said front end, a gas regulating means provided on said rear end to control gas flow through said gas outlet, and a downwardly extending gas inlet means engaging said gas cylinder to permit controlled release of gas contained in said gas cylinder through said gas outlet;

a protective cover assembly longer than and detachably fitted over said torch head, said protective cover assembly including a pair of elongated casing halves, which casing halves are hinged together on one side, and releasably secured to one another on the other side;

a spark igniter means mounted on said torch head; and means for generating a high voltage output to trigger said spark igniter means to produce a spark;

whereby, gas released at said gas outlet mixes with air to form a combustible mixture, said spark produced by said spark igniter means ignites the combustible mixture to produce a flame output.

2. The blowtorch as claimed in claim 1, wherein said high voltage generating means comprises:

a cell means having a low voltage output;

a voltage transforming means to transform said low voltage output to said high voltage output; and a switching means to selectively connect said cell means and said voltage transforming means.

3. The blowtorch as claimed in claim 2, wherein said protective cover assembly is made of metal, and said spark igniter means comprises:

an elongated ceramic insulator mounted on said torch head and extending from said front end to said rear end of said torch head; and an electrode extending axially through said ceramic insulator and having one end disposed adjacent to said gas outlet and the other end electrically connected to said voltage transforming means to receive said high voltage output, said one end of said electrode being spaced from one of said casing halves to cooperatively form a spark gap.

4. The blowtorch as claimed in claim 1, wherein said base further comprises:

a second plate projecting inward from said hollow body and into said hollow space, said second plate being vertically spaced from said first plate and being aligned with said opening;

a third plate disposed inside said hollow space between said opening and said second plate, said gas cylinder having a bottom end resting on said third plate; and a spring biasing said third plate away from said second plate.

5. The blowtorch as claimed in claim 1, wherein said first plate has an outer surface and an inner surface, said opening being gradually tapered from said outer surface to said inner surface.

6. The blowtorch as claimed in claim 1, wherein said other side of each said casing half cooperatively form an elongated crevice, said torch head further having an elongated plate blocking said elongated crevice to prevent gas flow through said crevice.

* * * * *